United States Patent [19]

Ariyama

[11] 3,936,045

[45] Feb. 3, 1976

[54] SHEET STRIPPING DEVICE FOR COPYING APPARATUS

[75] Inventor: Kenzo Ariyama, Tokyo, Japan

[73] Assignee: Ricoh Co., Ltd., Tokyo, Japan

[22] Filed: Feb. 15, 1974

[21] Appl. No.: 443,081

[30] Foreign Application Priority Data

Feb. 26, 1973 Japan ..... 48-24365[U]
May 31, 1973 Japan ..... 48-64720[U]

[52] U.S. Cl. ..... 271/174; 226/5; 271/DIG. 2
[51] Int. Cl.[2] ..... B65H 29/54
[58] Field of Search ..... 271/174, 193, 80, DIG. 2; 226/5

[56] References Cited

UNITED STATES PATENTS

| | | | |
|---|---|---|---|
| 3,684,363 | 8/1972 | Ito | 355/3 |
| 3,774,907 | 11/1973 | Borostyan | 271/80 |
| 3,804,401 | 4/1974 | Stange | 271/80 |

*Primary Examiner*—Richard A. Schacher
*Attorney, Agent, or Firm*—Cooper, Dunham, Clark, Griffin & Moran

[57] ABSTRACT

A device comprising a sheet pick-off member maintained in pressing engagement with one marginal portion of a specific zone of the peripheral surface of a drum with which one marginal portion of each copy sheet is adapted to be brought into engagement, and sheet guide means for guiding the leading end portion of each copy sheet to move away from the drum after being picked off the peripheral surface of the drum by the sheet pick-off member, so that each copy sheet adhering to the peripheral surface of the drum can be stripped. The device also comprises a sheet presser member arranged parallel to the sheet pick-off member and interposed between the sheet pick-off member and the other marginal portion of the peripheral surface of the drum so as to force against the peripheral surface of the drum the marginal portion of the sheet superposed on the sheet pick-off member.

1 Claim, 9 Drawing Figures

SHEET STRIPPING DEVICE FOR COPYING APPARATUS

BACKGROUND OF THE INVENTION

This invention relates to a sheet stripping device for stripping off the peripheral surface of a rotating drum a sheet which is maintained in intimate contact with a specific zone of the peripheral surface of the drum.

In one type of electrophotographic copying apparatus, the photosensitive layer made of a photoconductive material and provided on the peripheral surface of a drum is electrically charged in its entirety by a corona discharge, the charged photosensitive layer is exposed to an optical image of an original to be duplicated to form an electrostatic latent image thereon, and a visible toner image is formed by causing toner particles to adhere to the electrostatic latent image. A copy sheet is brought into pressing engagement with the peripheral surface of the drum to produce a duplicate of the visible toner image on such copy sheet by transfer printing, and the duplicate of the toner image is fixed so that a copy of the original can be produced.

In one method known in the art, the copy sheet brought into pressing engagement with the peripheral surface of the drum is stripped off the peripheral surface of the drum by blowing a stream of air between the copy sheet and the peripheral surface of the drum. This method has the disadvantage of the toner image formed on the copy sheet disintegrating because the toner particles are blown off the sheet by the air. In another method known in the art, sheet pick-off means comprising a plurality of sheet pick-off claws is actuated in synchronism with the rotation of the drum to bring the front ends of the claws into engagement with the peripheral surface of the drum when the leading end of each copy sheet adhering to the drum comes to a point at which the sheet is to be stripped off the drum. Some disadvantages are associated with this method. The copying apparatus must be additionally provided with a synchronizing device so as to actuate the sheet pick-off means synchronously with the drum. Since the sheet pick-off means is brought into engagement with the peripheral surface of the drum, the photosensitive layer on the latter tends to become damaged.

SUMMARY OF THE INVENTION

The present invention provides a sheet stripping device for copying apparatus which ensures that each copy sheet is stripped off the peripheral surface of a drum without damaging the photosensitive layer of the drum, and which operates independently of the rotation of the drum or feeding of copy sheets.

Another feature of the invention is the provision of a sheet stripping device for copying apparatus comprising a sheet pick-off member which never interferes with the duplication, on a copy sheet, of a toner image formed on the peripheral surface of the drum, and which is effective to prevent soiling or the developing of irregularities in color in one marginal portion of the copy sheet on which a toner image has been duplicated by transfer printing from the toner image on the peripheral surface of the drum.

An outstanding characteristic of the invention is that a sheet pick-off member in strip, claw or string form for picking a copy sheet off a specific zone of the peripheral surface of a rotating drum of a copying apparatus to which the sheet is fed is disposed in one marginal portion of the specific zone of the peripheral surface of the drum with which one marginal portion of each copy sheet is brought into engagement and maintained in pressing engagement with the peripheral surface of the drum so that each copy sheet can be positively picked off the drum, and sheet guide means is arranged in the vicinity of the peripheral surface of the drum to guide one marginal portion of the leading end portion of each copy sheet to move away from the drum after it is picked off the peripheral surface of the drum by the sheet pick-off member.

Another outstanding characteristic of the invention is that a sheet presser member is disposed parallel to the sheet pick-off member maintained in pressing engagement with one marginal portion of the specific zone of the peripheral surface of the drum and interposed between the sheet pick-off member and the other marginal portion of the peripheral surface of the drum so as to preclude the raising by the sheet pick-off member of each sheet from the peripheral surface of the drum more than is necessary.

DESCRIPTION OF EMBODIMENTS

Figure 1:
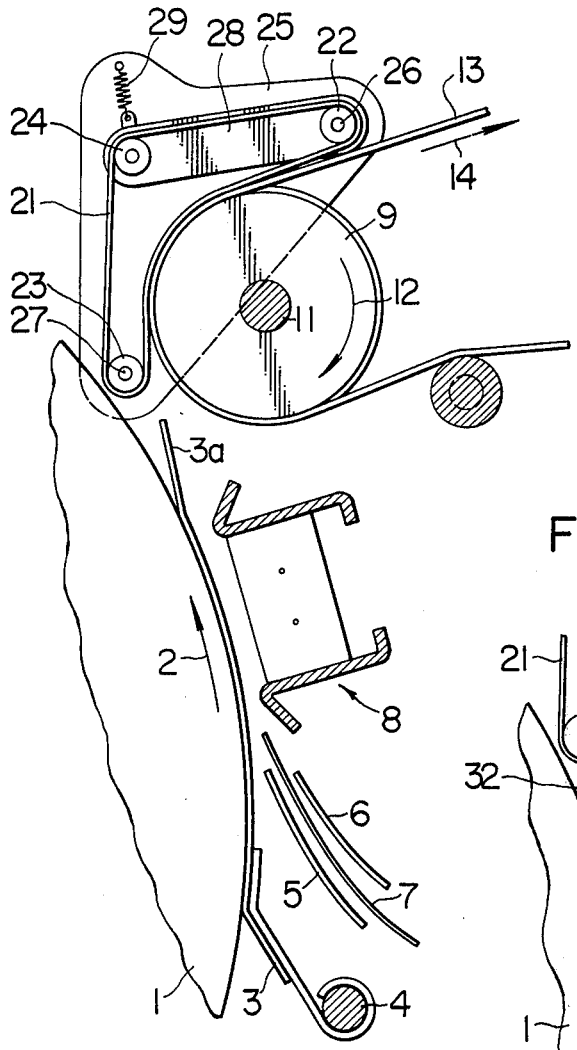
FIG. 1 is a side view of a sheet stripping device comprising one embodiment of the invention.
Figure 5:
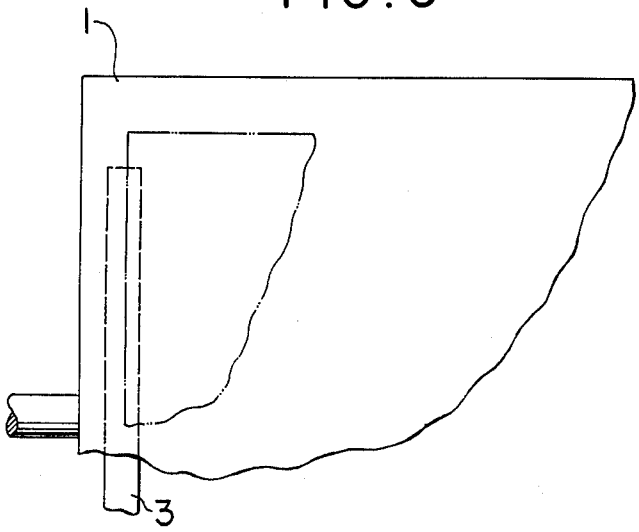
FIG. 5 is a fragmentary view of a drum as seen from the underside of its peripheral surface to show the relative positions of the sheet pick-off member and one marginal portion of a specific zone of the peripheral surface of the drum.

In FIG. 1, there is shown a drum 1 adapted to rotate in the direction of an arrow 2 and formed on its peripheral surface with a photosensitive layer made of a photoconductive material for forming thereon a toner image (not shown) by a known method. A sheet pick-off member 3 which is in the form of a strip of small thickness is maintained in pressing engagement with one marginal portion of a specific zone of the peripheral surface of the drum 1 (See FIG. 5). The sheet pick-off member 3 includes a base secured to a shaft 4 supported by an immovable member (not shown) of the copying apparatus as shown in FIG. 1, and a forward end portion 3*a* which is spaced apart from the peripheral surface of the drum 1 as shown in the figure.

Disposed in the vicinity of the sheet pick-off member 3 are guide plates 5 and 6 which function to guide a copy sheet 7 to move toward a specific zone of the peripheral surface of the drum 1. A charger 8 disposed above the guide plates 5 and 6 and in spaced juxtaposed relationship to the peripheral surface of the drum 1 performs the function of forming by transfer printing on the copy sheet 7 a duplicate of the toner image formed on the specific zone of the peripheral surface of the drum 1 and of bringing the copy sheet 7 into pressing engagement with the specific zone of the peripheral surface of the drum 1.

A roller 9 disposed above the charger 8 and in spaced juxtaposed relationship to the peripheral surface of the drum 1 is firmly secured to a shaft 11 supported by an immovable member (not shown) and adapted to rotate in the direction of an arrow 12 at substantially the same peripheral velocity as the drum 1. A plurality of conveyor belts 13, 13 trained about the roller 9 are adapted to move in the direction of an arrow 14 as shown in FIG. 1 to move away from the peripheral surface of the drum 1 the copy sheet 7 which is stripped off the peripheral surface of the drum 1 as subsequently to be described.

Figure 2:
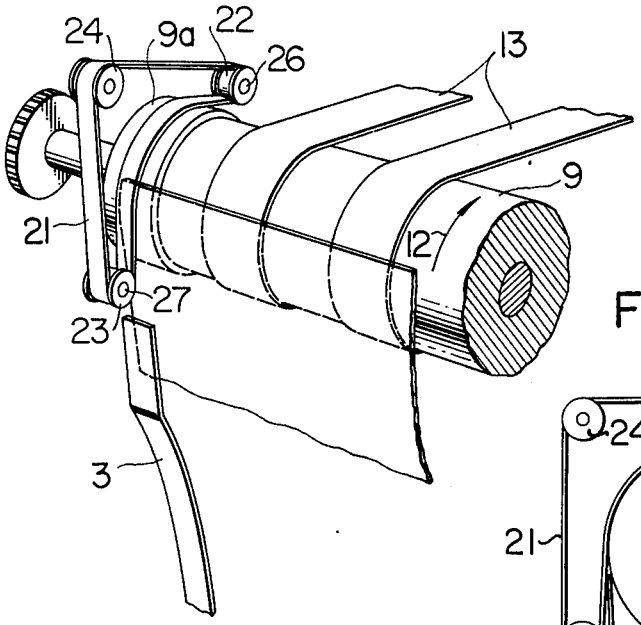
FIG. 2 is a perspective view of one form of sheet guide means of the sheet stripping device shown in FIG. 1.
Figure 3:
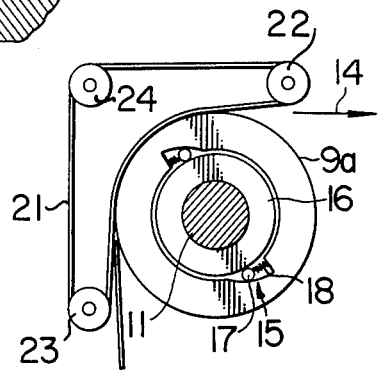
FIG. 3 is a side view of the sheet guide means of FIG. 2, showing one-way rotation clutch means mounted on a guide roller of the sheet guide means.

A guide roller 9*a* is loosely mounted on the shaft 11 and disposed against one marginal portion of the specific zone of the peripheral surface of the roller 9 which is disposed nearer to the sheet pick-off member 3 than the other marginal portion thereof, as shown in FIG. 2, and adapted to rotate independently of the roller 9. One-way rotation clutch means 15 is mounted between the guide roller 9*a* and the shaft 11 as shown in FIG. 3. As shown, the one-way rotation clutch means 15 is of a known type and comprises a boss 16 affixed to the shaft 11, and a steel ball 17 and a spring 18 mounted in a cutout formed in the inner periphery of the guide roller 9*a*. The one-way rotation clutch means 15 operates such that the rotational force of the shaft 11 is transmitted trough the one-way rotation clutch means 15 to the guide roller 9*a*, but, when it is desired to rotate the guide roller 9*a* clockwise with respect to shaft 11 in FIG. 3 from outside independently of the roller 9, the rotational force of the guide roller 9*a* is not transmitted to the shaft 11 to which the roller 9 is firmly secured. More specifically, when the roller 9 rotates in the direction of the arrow 12, the guide roller 9*a* rotates together with the roller 9 as a unit in the same direction. If the roller 9 remains stationary. however, it is possible to rotate the guide roller 9*a* alone clockwise from outside independently of the shaft 11 and roller 9.

An endless belt 21 for guiding the copy sheet is trained about a plurality of rollers 22, 23 and 24 as shown in FIG. 1 and FIG. 2, and a portion of the belt 21 is maintained in pressing engagement with the peripheral surface of the guide roller 9*a*. Rollers 22 and 23 are rotatably supported by shafts 26 and 27 respectively which are affixed to a support plate 25 secured to an immovable member (not shown), while roller 24 is rotatably supported at a free end of a lever 28 pivotally supported at its base by shaft 26. The lever 28 is urged to move clockwise in FIG. 1 about shaft 26 by the biasing force of a compression spring 29 mounted between the support plate 25 and the lever 28 so as to tension the endless belt 21.

Upon the copy sheet 7 being fed to the specific zone of the peripheral surface of the drum 1, the toner image already formed on the peripheral surface of the drum 1 is duplicated by transfer printing on the copy sheet 7. One marginal portion of the copy sheet 7 on which the toner image is formed by transfer printing is picked off the peripheral surface of the drum 1 by the forward end portion 3*a* of the sheet pick-off member 3. That is, a marginal portion of the leading end portion of the copy sheet 7 which rides on the forward end portion 3*a* of the sheet pick-off member 3 is spaced apart from the peripheral surface of the drum 1, but the distance between the leading end portion of the copy sheet 7 and the peripheral surface of the drum 1 grows smaller in going from one marginal portion of the peripheral surface of the drum 1 at which the forward end portion 3*a* is disposed to the other marginal portion of the peripheral surface of the drum 1.

Figure 4:
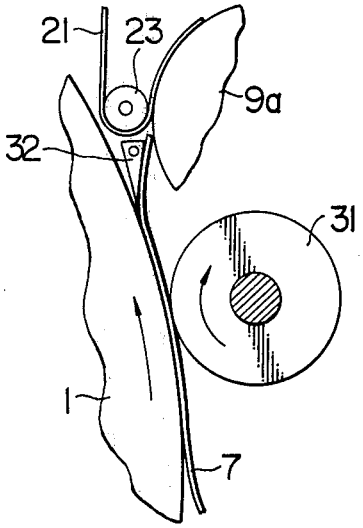
FIG. 4 is a fragmentary side view of a sheet stripping device comprising another embodiment of the invention.

The marginal portion of the copy sheet 7 picked off the peripheral surface of the drum 1 by the pick-off member 3 is held between the endless belt 21 and the guide roller 9*a* rotating together with the roller 9, so that the entire copy sheet 7 is stripped off the peripheral surface of the drum 1 and conveyed by the conveyor belts 13 in the direction of the arrow 14. That is, the copy sheet 7 whose one marginal portion is picked off the peripheral surface of the drum 1 is moved away from the drum 1 by the conveyor belts 13 after the rest of the sheet 7 is stripped off the peripheral surface of the drum 1 by the belts 13. It should be noted that the static charge build-up formed in the copy sheet 7 by the charging action of the charger 8 facilitates the separation of the copy sheet 7 from the peripheral surface of the drum 1 because the sheet 7 tends to adhere to the endless belts 13 by virtue of the static build-up In FIG. 1, the charger 8 is shown as being used as a means for bringing the copy sheet 7 into intimate contact with the specific zone of the peripheral surface of the drum 1 and the sheet pick-off member 3 in strip form is shown as being used as a means for picking the sheet 7 off the peripheral surface of the drum 1. These functions may also be performed by mechanisms such as shown in FIG. 4. In the figure, the copy sheet 7 is maintained in pressing engagement with the peripheral surface of the drum 1 by a hold-down roller 31 so that the toner image on the drum surface may be duplicated by transfer printing on the sheet. The hold down roller 31 is constructed such that it is brought into pressing engagement with the peripheral surface of the drum 1 and rotates in the direction of an arrow in slaved relation to the drum 1 only when the copy sheet 7 is fed to the drum. However, the hold-down roller 31 is spaced apart from the drum 1 when no copy sheet is fed to the latter. In FIG. 4, the sheet pick-off member 32 shown is in claw form and disposed in a position which is on one marginal position of a specific zone of the peripheral surface of the drum 1 as is the case with the sheet pick-off member 3. The copy sheet 7 has one marginal portion of its leading end portion picked off the peripheral surface of the drum 1 by the pick-off member 32, and is stripped off the peripheral surface of the drum 1 as it is caught by the guide roller 9*a* and endless belt 21 as described previously.

Figure 6:
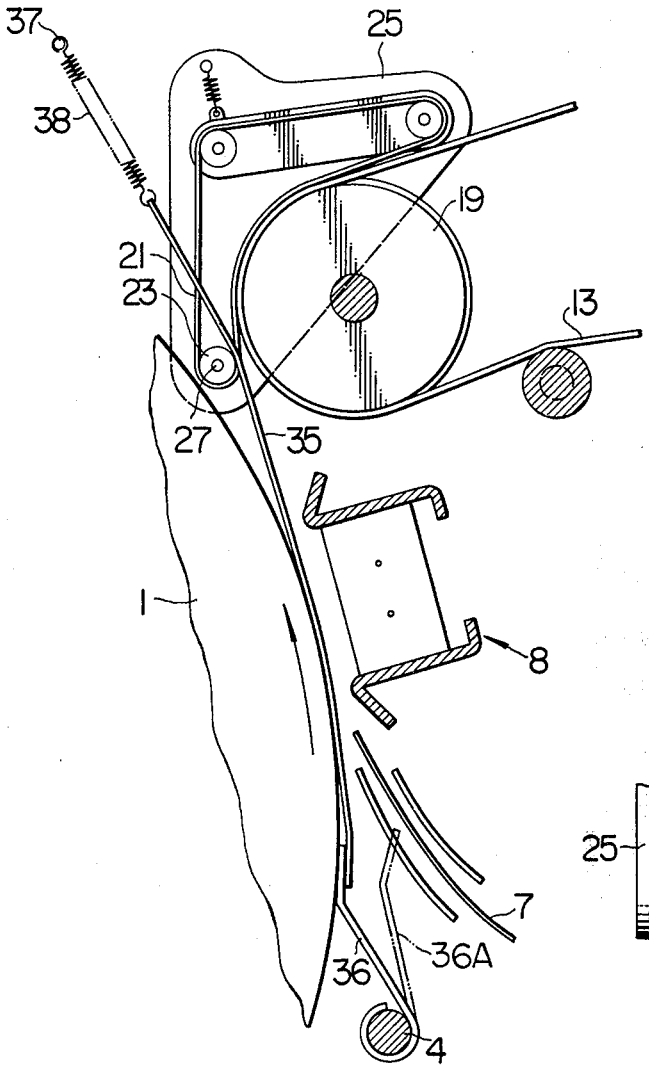
FIG. 6 is a side view of the sheet stripping device comprising another embodiment of the invention.
Figure 7:
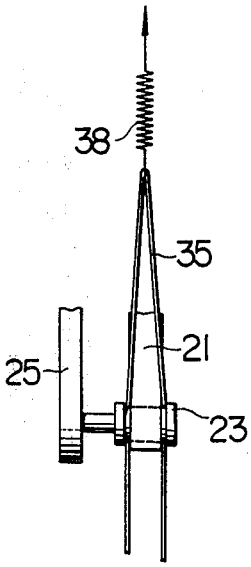
FIG. 7 is a front view of a sheet pick-off member of the sheet stripping device shown in FIG. 6.

FIG. 6 and FIG. 7 show another form of sheet pick-off member. As shown, the sheet pick-off member 35 is in the form of a string which may be made of any non-metallic resilient and insulating material. For example, a fishing line may be used as the sheet pick-off member 35. The sheet pick-off member 35 in string form which has its main portion maintained in engagement with one marginal portion of a specific zone of the peripheral surface of the drum is supported at its base by a free end of a supporter 36 secured to the shaft 4. A forward end of the member 35 is secured to one end of a spring 38 connected at the other end to a pin 37, after a portion of the pick-off member 35 is brought into engagement with the roller 23 or the shaft 27 supporting the same as seen in FIG. 7.

The use of the member 35 offers many advantages. Since the sheet pick-off member 3 shown in FIG. 1 is in strip form, it is impossible to maintain the pick-off member 3 in intimate contact with the drum 1 in a stable manner because the member 3 may be released from engagement with the drum 1 by vibration or the like. The use of the sheet pick-off member 35 in string form offers the advantage of being able to maintain the member 35 positively in intimate engagement with the drum 1 at all times. Besides, since a string is smaller in width than a strip, the area of the copy sheet not available for copying can be reduced. Being made of a nonmetallic material, the member 5 is impervious to the influences exerted by the charger 8. When it is desired to mount or remove the drum 1 after the sheet pick-off member 35 is mounted, the mounting or removing operation can be readily performed if the supporter 36 is moved to a dash-and-dot line position 36A in FIG. 6 so as to thereby move the sheet pick-off member 35 away from the peripheral surface of the drum 1.

It will be seen that in both embodiments the endless belt 21 can be readily trained over the guide roller 9*a* and rollers 22, 23 and 24 by pushing and moving the lever 28 downwardly. The old belt 21 can be readily replaced by a new one by performing the operation described above. When the sheet 7 gets stuck between the guide roller 9*a* and belt 21, the sheet 7 can be readily withdrawn from between the guide roller 9*a* and the belt 21 by pulling the sheet 7 in the direction of the arrow 14. If the guide roller 9*a* were integral with the roller 9, it would be impossible to withdraw the jammed sheet 7 from between the guide roller 9*a* and the belt 21 and the belt 21 would be damaged if the sheet 7 were pulled in the direction of the arrow 14 after the roller 9 has become stationary, because it is impossible from outside to move the roller 9 which is connected to a drive (not shown).

The provision of the one-way rotation clutch means 15 permits the jammed copy sheet 7 to be readily withdrawn from between the guide roller 9*a* and the belt 21. The belt 21 is maintained in contact with the guide roller 9*a* which is loosely mounted on the shaft 11 through the one-way rotation clutch means 15. This arrangement permits the guide roller 9*a* to rotate independently of the roller 9 and enables the belt 21 to be moved by the rotation of the guide roller 9*a* if the jammed copy sheet 7 is pulled in the direction of the arrow 14 while maintaining the roller 9 stationary. Thus, the jammed copy sheet 7 can be readily withdrawn.

Figure 8:
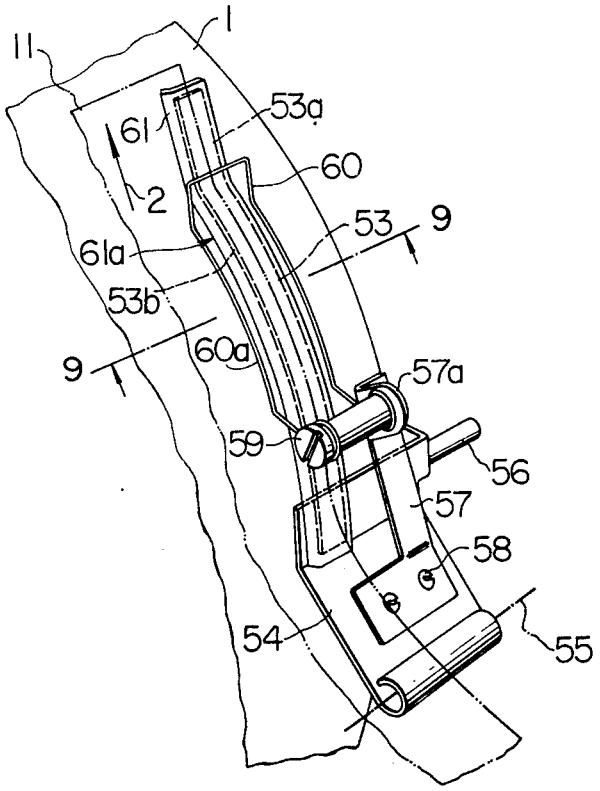
FIG. 8 is a perspective view of still another embodiment of the invention, showing essential portions alone of a sheet stripping device.

In FIG. 8, there is shown a sheet pick-off member 53 affixed at its base to a supporter 54 which is rotatably supported by a shaft 55 connected to an immovable member (not shown). The sheet pick-off member 55 is urged by the biasing force of a spring (not shown) into pressing engagement with a specific zone of the peripheral surface of the drum 1. A knob 56 is affixed to the supporter 54, so that when the knob 56 is turned it is possible manually to rotate the supporter 54 about the shaft 55 to release the sheet pick-off member 53 from engagement with the peripheral surface of the drum 1.

A mounting plate 57 is secured at its base to the supporter 54 by screws 58 and has at its forward end a bent portion 57*a* to which a shaft 59 is affixed at its base. A presser member 60 is wound at its base on the shaft 59 so that the base may act as a spring. Thus, the presser member 60 is brought into pressing engagement with the peripheral surface of the drum 1 by the biasing force of the base of the presser member 60 serving as a spring. The presser member 60 includes a portion which is disposed parallel to the sheet pick-off member 53 and interposed between the member 53 on one marginal portion of the specific zone of the peripheral surface of the drum 1 and the other marginal portion thereof. A thin plate 61 which may be a polyester film is attached to the upper surface of the sheet pick-off member 53 and includes one marginal portion 61*a* which extends beyond an edge 53*b* of the sheet pick-off member 53.

Figure 9:
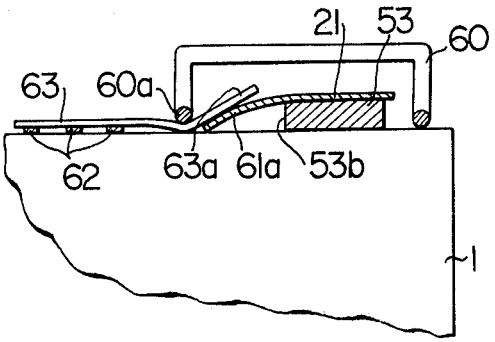
FIG. 9 is a sectional view taken along the line 9—9 of FIG. 8.

As seen in FIG. 9*a* toner image 62 which has been formed in the specific zone of the peripheral surface of the drum 1 by electric charging, exposing to an optical image of an original and developing is duplicated by transfer printing on the surface of a copy sheet 63 fed to the drum 1 as the copy sheet 63 is brought into pressing engagement with the specific zone of the peripheral surface of the drum by the charging device (See FIG. 1). During the time the copy sheet 63 is fed to the drum 1, one marginal portion 63*a* thereof (See FIG. 9) passes between the sheet pick-off member 53 and the shaft 59 (See FIG. 8). As a result, the outer edge of the marginal portion 63*a* of the copy sheet 63 rides on the sheet pick-off member 53 and a portion of the marginal portion 63*a* remote from the outer edge is forced by a side edge 60*a* of the presser member 60 against the peripheral surface of the drum 1 as shown in FIG. 9. The marginal portion 63*a* of the sheet 63 is guided by a forward end portion 53*a* of the sheet pick-off member 53 to move gradually away from the peripheral surface of the drum 1, and the sheet 63 is stripped off the drum 1 as the former is guided by suitable guide means, like the one previously described.

When the toner image 62 on the drum 1 is duplicated by transfer printing on the copy sheet 63, the marginal portion 63*a* of the latter tends to be raised from the peripheral surface of the drum 1 as it rides on the sheet pick-off member 53. However, since the marginal portion of the sheet 63 is forced against the peripheral surface of the drum 1 by the presser member 60, irregularities of the toner image transferred from the drum 1 to the sheet 63 can be positively prevented from occurring in the marginal portion of the sheet 63 regardless of the thickness of the sheet used.

A developing liquid or toner solvent tends to be gradually collected around the sheet pick-off member 53 as it slides on the peripheral surface of the drum 1. However, since a duct is formed by the marginal portion 61*a* of the thin plate 61, the edge 53*b* of the sheet pick-off member 53 and the peripheral surface of the drum 1 as shown in FIG. 9, it is possible to keep the developing liquid or toner solvent from finding its way into the under surface of each sheet fed to the drum 1, thereby precluding the production of unacceptable copies.

What is claimed is:

1. A sheet stripping device for copying apparatus provided with a drum adapted to rotate continuously in one direction, and a sheet feed device for feeding one copy sheet after another to a specific zone of the peripheral surface of the rotating drum, said sheet stripping device comprising the combination of:

a. a sheet pick-off member arranged near one marginal portion of the specific zone of the peripheral surface of the drum and including:

i. a base portion maintained in pressing engagement with said one marginal portion of said zone and with which one marginal portion of each copy sheet fed by said sheet feed device to the drum is brought into pressing engagement; and ii. a forward end portion whose surface is increasingly spaced from the peripheral surface of the drum beyond said zone in the direction of drum rotation to pick off said marginal portions of said copy sheets from engagement with the drum surface beyond said zone;

b. sheet strip-off means disposed adjacent to and spaced from the surfaces of said drum and said sheet pickoff member for catching one marginal portion of the leading end portion of each copy sheet picked off the peripheral surface of the drum by said sheet pick-off member and for pulling the sheet away from the drum, said sheet strip-off means comprising:

i. a shaft disposed parallel to the center axis of said drum and adapted to rotate in a direction opposite to the direction of rotation of said drum;

ii. a guide roller supported on said shaft for rotation therewith; and iii. an endless belt having one portion maintained in pressing engagement with a portion of the peripheral surface of the guide roller, said guide roller and said endless belt cooperating with each other to hold therebetween one marginal portion of the copy sheet; and c. one-way rotation clutch means interposed between said guide roller of said sheet strip-off means and the shaft supporting said guide roller, for permitting said guide roller to rotate relative to said shaft in a direction in which each sheet moved by said guide roller is conveyed.

2. A sheet stripping device according to claim 1 wherein said sheet pick-off member is a thin strip and includes a base supported by an immovable member of the copying apparatus.

3. A sheet stripping device according to claim 1 wherein said sheet pick-off member is a thin string and includes a base supported by an immovable member of the copying apparatus to which the rear end of the string is connected and a spring connected to the forward end of the string to tension the sheet pick-off member.

4. A sheet stripping device according to claim 1 further comprising a roller substantially of the same length as the drum firmly secured to said shaft supporting said guide roller, and a plurality of conveyor belts trained over said roller to move out of the copying apparatus the sheet delivered by said sheet strip off means.

5. A sheet stripping device for copying apparatus provided with a drum adapted to rotate continuously in one direction, and a sheet feed device for feeding one copy sheet after another to a specific zone of the peripheral surface of the rotating drum wherein the improvement comprises the combination of:

a. a sheet pick-off member arranged on and maintained in pressing engagement with one marginal portion of the specific zone of the peripheral surface of said drum and with which one marginal portion of each copy sheet fed by said sheet feed device to the drum is brought into pressing engagement, said sheet pick-off member including a forward end portion whose surface is increasingly spaced apart from the peripheral surface of the drum in the direction of drum rotation to pick off said marginal portions of said copy sheets from pressing engagement with the peripheral surface of the drum;

b. sheet strip-off means spaced from the surfaces of said drum and said pick-off member for catching the leading end portion of each copy sheet and for pulling the copy sheet in a direction away from the drum after the copy sheet is picked off the drum by said sheet pick-off member; and c. a sheet presser member disposed parallel to said sheet pick-off member and interposed between the sheet pick-off member and the other marginal portion of the peripheral surface of the drum so as to force against the peripheral surface of the drum a portion of said one marginal portion of the sheet superposed on the sheet pick-off member.

6. A sheet stripping device according to claim 5 wherein said sheet presser member is a wire including a base supported by an immovable part of the copying apparatus.

* * * * *